US005657989A

United States Patent [19]

Acoba

[11] Patent Number: 5,657,989

[45] Date of Patent: Aug. 19, 1997

[54] FAMILY CHORE BOARD GAME

[76] Inventor: Corwin Acoba, P.O. Box 612, Lawai, Kauai, Hi. 96765

[21] Appl. No.: 553,915

[22] Filed: Nov. 6, 1995

[51] Int. Cl.[6] ..... A63F 3/00

[52] U.S. Cl. ..... 273/249

[58] Field of Search ..... 273/242, 243, 273/248, 249, 246

[56] References Cited

U.S. PATENT DOCUMENTS

| | | | |
|---|---|---|---|
| D. 136,008 | 7/1943 | Brooks | 273/249 X |
| 850,137 | 4/1907 | Collier | 273/249 |
| 1,463,871 | 8/1923 | Chisolm | 273/246 |
| 1,490,153 | 4/1924 | Wischhusen | 273/249 |
| 1,695,144 | 12/1928 | Edwards | 273/249 |
| 1,825,673 | 10/1931 | Latimer . | |
| 2,062,168 | 11/1936 | Entwistle | 273/246 |
| 2,766,987 | 10/1956 | Seelbrede et al. . | |
| 3,708,169 | 1/1973 | Hoy . | |
| 4,497,490 | 2/1985 | Rogers | 273/249 |
| 5,248,149 | 9/1993 | Tarrats . | |
| 5,398,938 | 3/1995 | Money | 273/246 X |

FOREIGN PATENT DOCUMENTS

| | | | |
|---|---|---|---|
| 2626779 | 8/1989 | France | 273/249 |

*Primary Examiner*—William E. Stoll
*Attorney, Agent, or Firm*—Michael I. Kroll

[57] ABSTRACT

A family chore board game (10) comprising a game board (12) having thereon a sequence of playing zones (14) defining a path of travel. A plurality of playing pieces (16) are provided. Each playing piece (16) is used by each player to be positional within the playing zones (14) on the game board (12). A deck of standard playing cards (18) are also provided. Two of the standard playing cards (18) and possibly an additional third standard playing card (18) are dealt to each of the players. Specific various combinations are to be made by the standard playing cards (18) to indicate moves needed by each player, so that the playing pieces (16) will travel along the playing zones (14). The first player to move the respective playing piece (16) from the first starting playing zone (14) to the last finishing playing zone (14) will win the game (10).

10 Claims, 3 Drawing Sheets

Fig.5 GREEN FRIENDS PRIZE CARDS

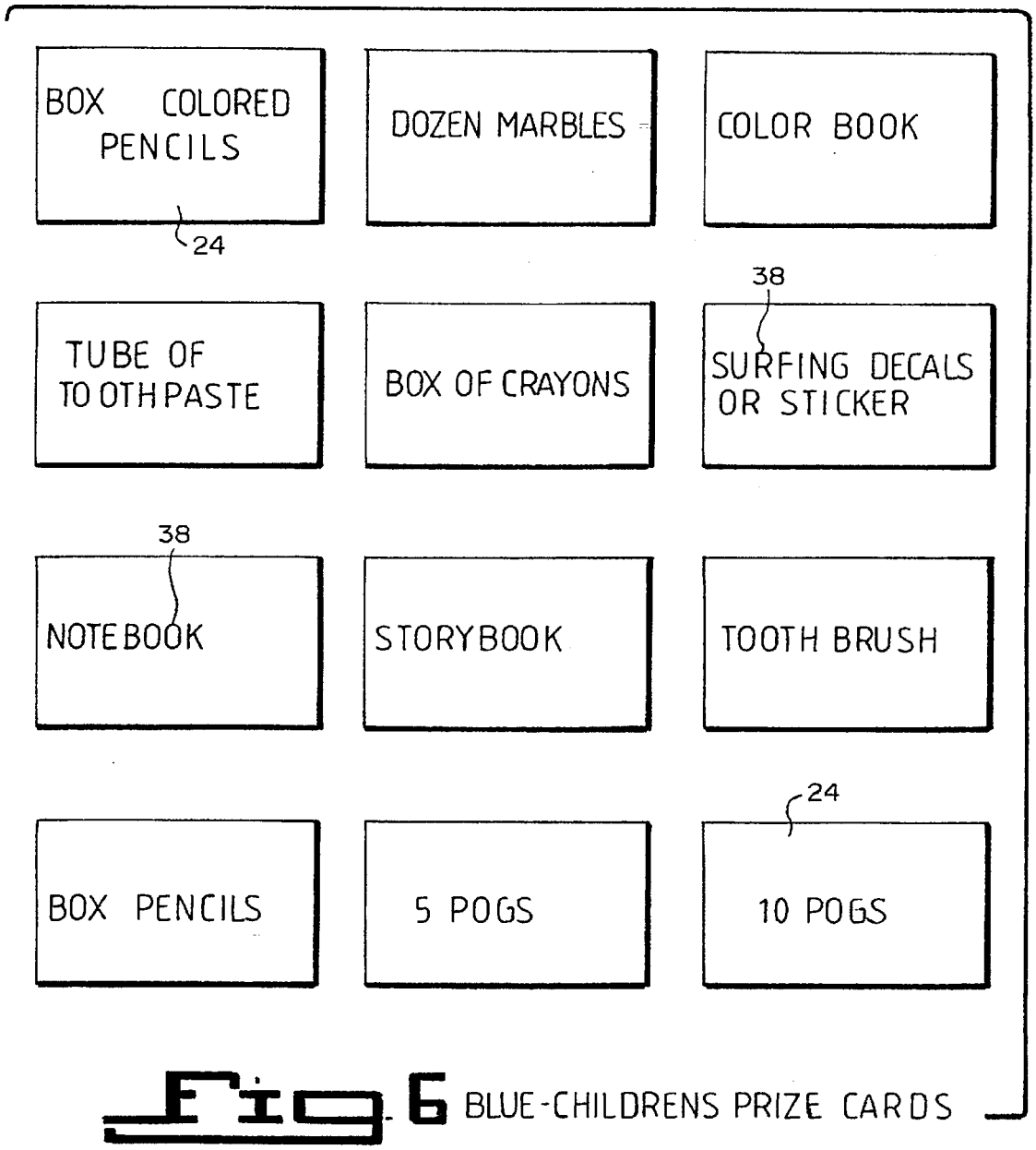
Fig. 6 BLUE-CHILDRENS PRIZE CARDS

FAMILY CHORE BOARD GAME

BACKGROUND OF THE INVENTION

1. Field of the Invention

The instant invention relates generally to board games and more specifically it relates to an addicted to sevens game.

2. Description of the Prior Art

Numerous board games have been provided in prior art. For example, U.S. Pat. Nos. 1,825,673 to Latimer; 2,766,987 to Seelbrede et al.; 3,708,169 to Hoy and 5,248,149 to Tarrats all are illustrative of such prior art. While these units may be suitable for the particular purpose to which they address, they would not be as suitable for the purposes of the present invention as heretofore described.

LATIMER, ALBERT N.

GAME BOARD

U.S. Pat. No. 1,825,673

In combination a game board and a plurality of game pieces, certain of which constitute markers denoting, respectively, trumps, no trump, dealer, and winner. The face of the board is divided into four divisions representing players indicated as North, East, South and West, respectively. Each division is divided into two sections by a trump declared column. All of the sections are divided into four longitudinal columns designating the respective game piece suits and into thirteen vertical columns representing the game piece face designations and forming 52 squares adapted to receive the respective game pieces according to their suit and face designations. The other complemental section is similarly divided into 52 squares representing suit and trick numbers. Each square is adapted to receive and record a respective game piece according to its suit and number of trick in which played. A space adjacent each of the latter sections is adapted to receive a game piece representing the winner.

SEELBREDE, HERBERT B.

KNEPSHIELD, CORALIE

GAME BOARD AND PIECES

U.S. Pat. No. 2,766,987

In a card-peg-board game, in combination, a plurality of cards, a plurality of pegs and a game board. The game board has a flat play surface of square outline and provides a playing station along each side. The play surface is a plurality of spaced parallel marking lines extending normal to one side of the play surface and a second plurality of spaced parallel marking lines extending normal to the first mentioned plurality of marking lines and forming a plurality of square areas on the play surface. All of the square areas in a closed block pyramidic figure in front of each play station has its pyramidic base along one side of the play surface defining a field of play for that play station. All of the square areas within each field of play are of the same color and different from the color of any other square areas on the play surface. The square areas on the playing surface remaining and outside the fields of play are of the same color and different from the color of any other square area on the play surface and are in two straight lines extending diagonally across the play surface and intersect at the center of the play surface. The play surface has a plurality of holes. Each hole is at each intersection of the marking lines. The plurality of pegs comprise four sets of pegs. The pegs of each set of pegs are of the same color as one of the fields of play and are each insertable in a hole of the plurality of holes in the play surface. The plurality of cards comprise four sets of cards. The cards of each set of cards are imprinted with an alphabetic letter symbol in the same color as one of the fields of play. The holding of a card determines, by its color imprint, the color of the field of play into a hole of which the card holder may place and insert a peg of the color of the field of play at the play station of the card holder to the end. By holding cards, pegs of the color of the field of play in front of the card holder are progressively placed in the holes at the most of all four corners of a plurality of the square areas. At the same time, a plurality of cards having by their alphabetic letter symbols a word spelling relation are cumulatively assembled. By the placing of pegs and assembling of cards, a score in the game is made.

HOY, ALTON P.

MATHEMATICAL CARD GAME

U.S. Pat. No. 3,708,169

A mathematical card game playable by two or more persons with a deck of numbered cards of two suits each containing cards numbered in an arithmetical progression extending from a plus number through zero to the corresponding minus number. The game is played for tricks, each player following suit if possible. Each trick is taken by the card having the highest mathematical value and the game is won by the player having the highest positive score or total value of cards won or if played with a "pot" or if played with a "pet" or "kitty", by all players having positive scores. A player thus can win the most cards or tricks and still lose, if his cards either have a lower value than those of another player or have a negative value. Accompanying marked and unmarked pegs and a peg board having two sets of holes marked with the numbers on the cards, show the cards of the suit led played during each trick and also all of the cards previously played at any time during the game.

TARRATS, EDWARD

METHOD OF PLAYING TIC-TAC-TOE WITH CARDS

U.S. Pat. No. 5,248,149

A method of playing tic-tac-toe involves using cards and playing grid of at least three-by-three with spaces to accommodate a card. The cards have at least two different types of indicia, for example, X's and O's. A first player draws a card from a deck of such cards and designates the type of card drawn as his type of card. The first player then places this card in an unused space in the grid. The second player then draws a card from the deck. If it is the same type as that designated for the first player, the second player discards it such as by placing it on top of the card which has already been played. If the card selected by the second player is of a different type from that designated for the first player, the second player places it in any unused space in the grid. In a preferred embodiment, the deck also includes cards which when played on top of any other card renders the spaced unused.

SUMMARY OF THE INVENTION

A primary object of the present invention is to provide an addicted to sevens game that will overcome the shortcomings of the prior art devices.

Another object is to provide an addicted to sevens game that utilizes a standard deck of playing cards to determine the moves of each player by picking two or three cards.

An additional object is to provide an addicted to sevens game that is a unique card game that is played at a fast pace and is not boring.

A further object is to provide an addicted to sevens game that is simple and easy to use.

A still further object is to provide an addicted to sevens game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 5 shows a plurality of the friends prize cards.

FIG. 6 shows a plurality of the children's prize cards.

Similar reference characters denote corresponding features consistently throughout the attached drawings.

DETAILED DESCRIPTION OF THE PREFERRED EMBODIMENTS

Figure 1:
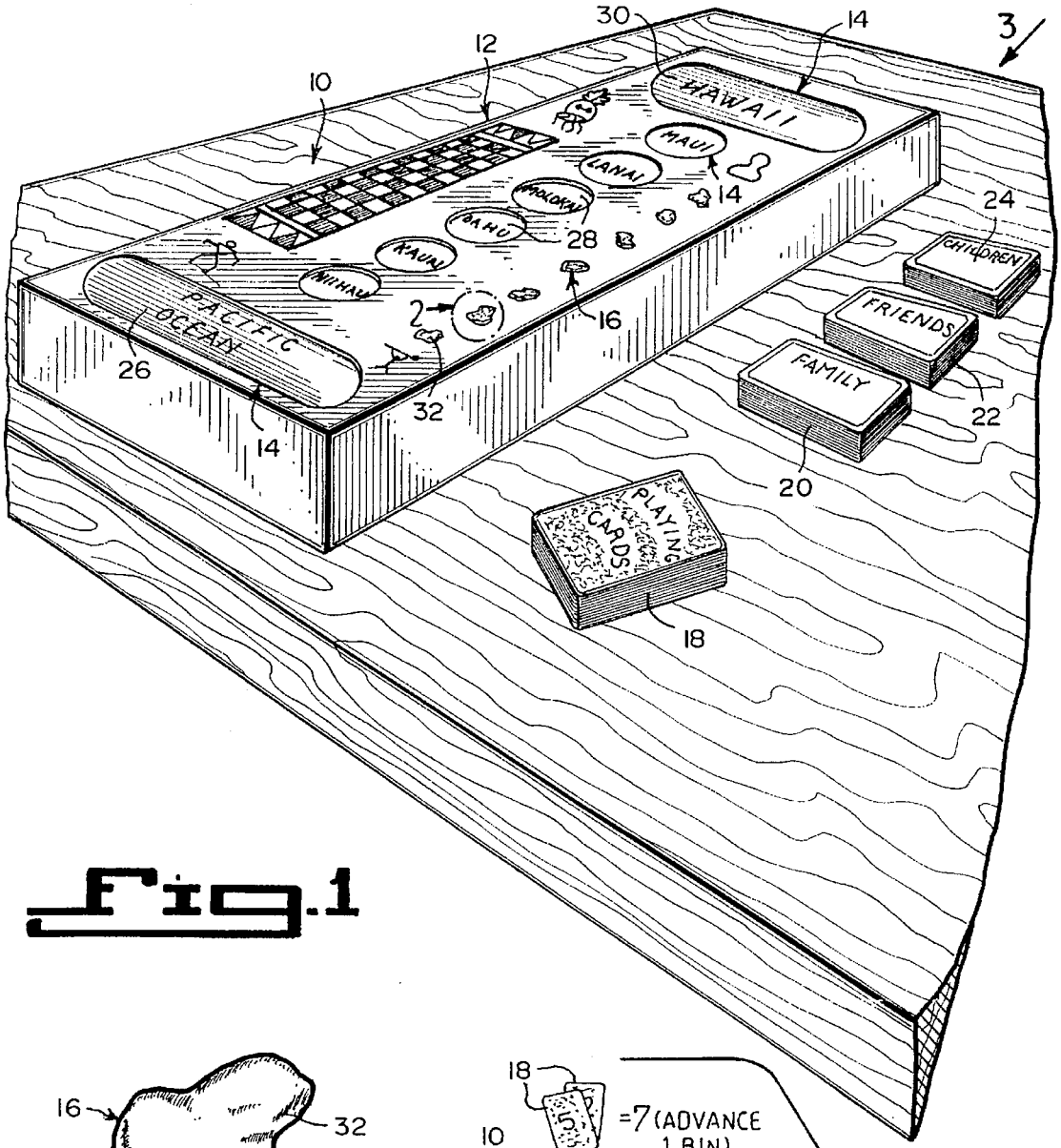
FIG. 1 is a perspective view showing the various components of the instant invention.
Figure 3:
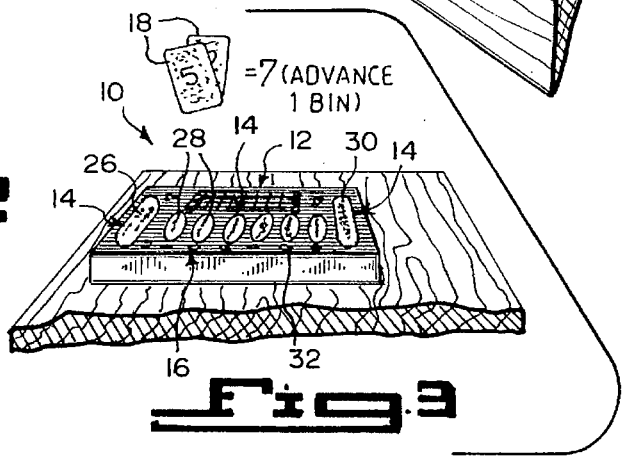
FIG. 3 is a perspective view taken in the direction of arrow 3 in FIG. 1, showing two picked playing cards equalling the number seven, so that a player can advance a playing piece one bin.

Turning now descriptively to the drawings, in which similar reference characters denote similar elements throughout the several views, FIGS. 1 and 3 illustrate an addicted to sevens game 10, comprising a game board 12 having thereon a sequence of playing zones 14 defining a path of travel. A plurality of playing pieces 16 are provided. Each playing piece 16 is used by each player to be positional within the playing zones 14 on the game board 12.

A deck of standard playing cards 18 are also provided. Two of the standard playing cards 18 and possibly an additional third standard playing card 18 are dealt to each of the players. Specific various combinations are to be made by the standard playing cards 28 to indicate moves needed by each player, so that the playing pieces 16 will travel along the playing zones 14. The first player to move the respective playing piece 16 from the first starting playing zone 14 to the last finishing playing zone 14 will win the game 10.

The addicted to sevens game 10 further includes a deck of family chore cards 20. The winning player will pick one of the family chore cards 20, if the game 10 is played among family members. A deck of friends prize cards 22 are provided. The winning player will pick one of the friends prize cards 22, if the game 10 is played among friends. A deck of children's prize cards 24 are also provided. The winning player will pick one of the children's prize cards 24, if the game is played among children.

Figure 2:
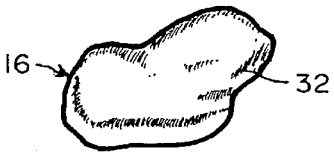
FIG. 2 is an enlarged perspective view as indicated by arrow 2 in FIG. 1, showing one of the playing pieces in greater detail.

As best seen in FIG. 1, the playing zones 14 on the game board 12 consists of the first starting playing zone being a large recessed bin 26 indicating the Pacific Ocean. The six intermediate playing zones are small recessed bins 28 indicating inhabited islands of Hawaii, which are Niihau, Kauai, Oahu, Molokai, Lanai and Maui. The last finishing playing zone is a large recessed bin 30 indicating the inhabited island of Hawaii. The playing pieces 16, one of which is best seen in FIG. 2, are different colored stones 32, which are natural to the Hawaiian islands and are each called "pohaku" in the Hawaiian language.

The deck of standard playing cards 18 contains all of the cards numbered between two and ten representing that numerical value. All of the cards being aces representing the number one. All of the cards being the picture cards representing the number ten. When two cards 18 are dealt to each player, a combination of seven will advance the respective playing piece 16 one forward playing zone 14. When three cards 18 are dealt to each player a combination of seven, seventeen, twenty seven, three of the same suit and a straight of three will advance the respective playing piece 16 one forward playing zone 14. Three of a kind and a straight flush of three will advance the respective playing piece 16 two forward playing zones 14. When three sevens are dealt, that player will automatically win.

Figure 4:
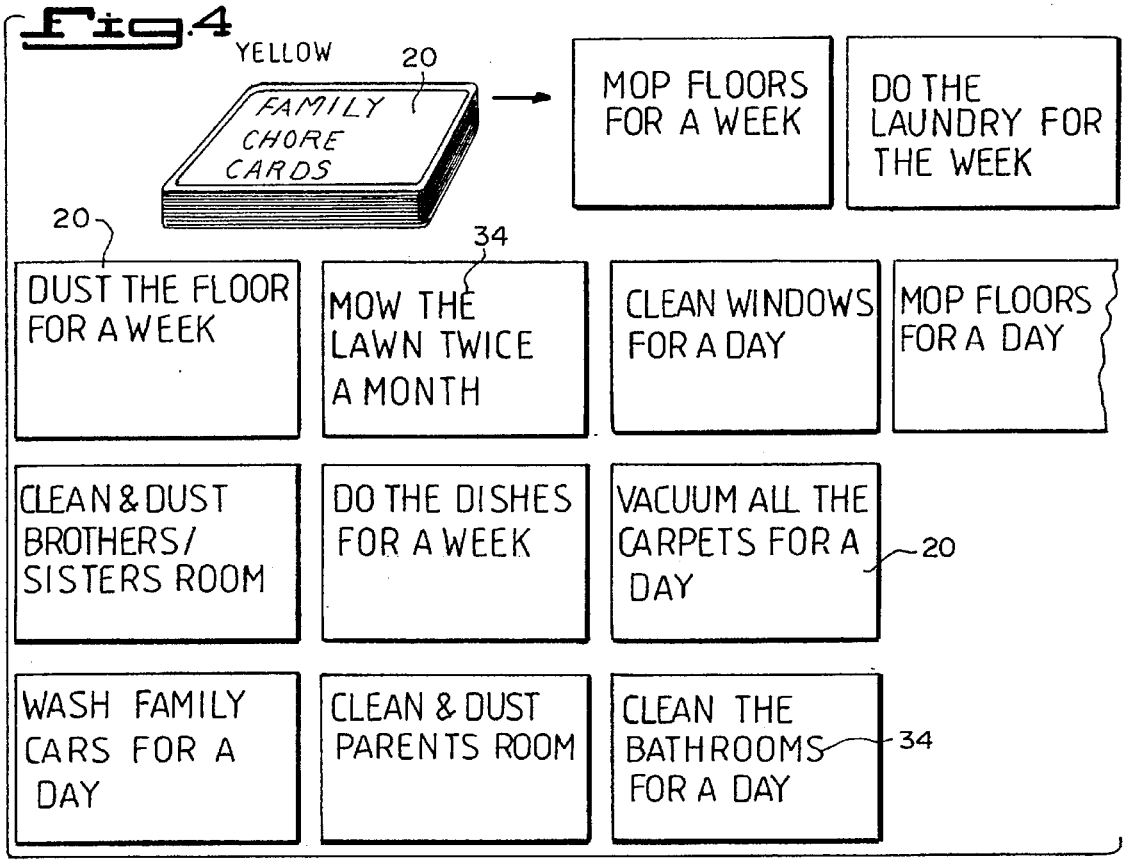
FIG. 4 shows a plurality of the family chore cards.
Figure 4:
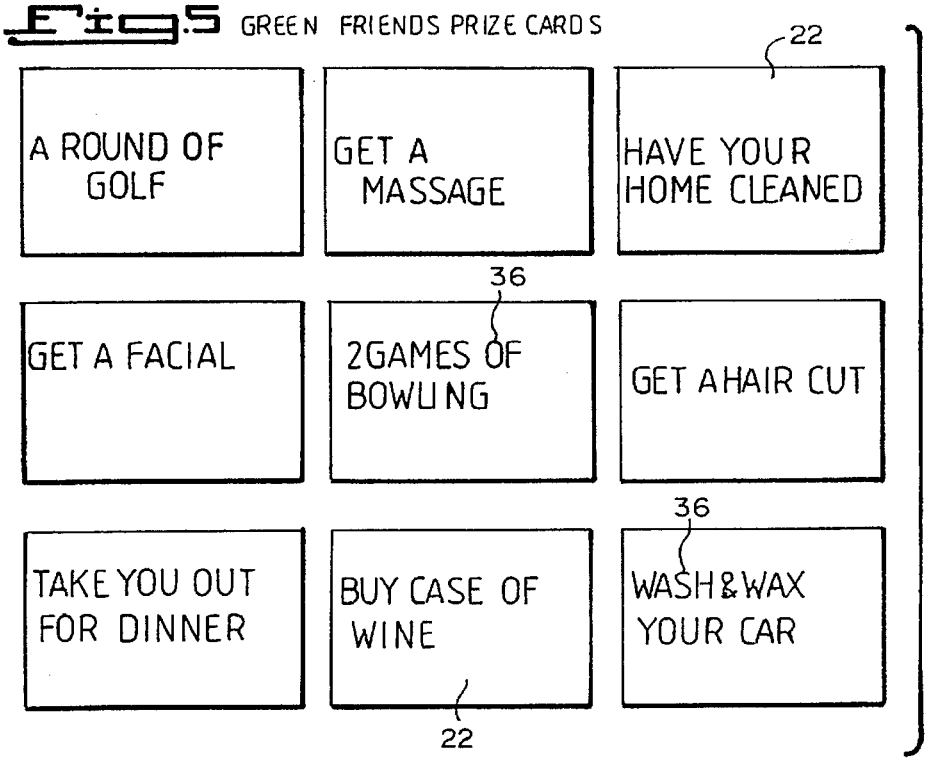

Each family chore card 20, as best seen in FIG. 4, is yellow in color and includes a printed message 34 thereon, so that the winning player will perform a specific task. Each friends prize card 22, as best seen in FIG. 5, is green color and includes a printed message 36 thereon, so that the winning player being an adult will receive a specific gift. Each children's prize card 24, as best seen in FIG. 6, is blue in color and includes a printed message 38 thereon, so that the winning player being a child will receive a specific gift.

RULES OF THE GAME

Number of Players: Two to Seven—Ages eight and above.

Object of the fame: The player starting at the Pacific Ocean bin who reaches to the other end first, which is the Hawaii bin will be declared the winner. The smaller bins are named after all the major islands of Hawaii that people live on. These are the bins which the players advance through. The game doesn't take any strategy. It's just pure luck and fun.

Directions: All players place their playing pieces in the Pacific Ocean bin on the playing board. Their goal will be to advance towards the other large bin, which is Hawaii. That will determine who is the winner. Players will be dealt two cards each. If their cards total seven, they advance their playing piece to the next bin. Other players who do not have a total of seven, could ask for another card. There will be three cards allowed per hand. If the three cards add up to seven, seventeen or twenty seven, that player will also advance the playing piece to only one bin. All the picture cards are considered tens, while aces are ones.

Other Ways to Advance:

1. Three of the same suit: Example: four of clubs, ten of clubs and king of clubs; five of hearts, two of hearts, eight of hearts, etc.—Advance a playing piece one bin.

2. Advance on straights any suit: Example: ace of clubs, two of hearts, three of diamonds, four of diamonds, five of spades and six of hearts, etc.—Advance a playing piece one bin.
3. Advance on three of a kind: Example: three kings, three aces, three fours, etc.—Advance a playing piece two bins.
4. Advance on straights: Same suits—Advance two playing pieces two bins.
5. Automatic winner: "The Elusive Sevens"—Picking three sevens.

The deck of cards is dealt by all the people playing. If the deck doesn't have enough cards for a last hand, the deck is passed to the next player who reshuffles it and continues to deal. The deck is always passed clockwise.

If children play together, have an adult deal for them and see that they are supervised. In other words, you become the referee.

The winner picks from cards of chores or prizes, depending if playing among family members, with friends or children. All losers contribute to the winner. They will split costs or chores among themselves.

LIST OF REFERENCE NUMBERS

10 addicted to sevens game
12 game board of 10
14 playing zone on 12
16 playing piece of 10
18 standard playing card of 10
20 family chore card of 10
22 friends prize card of 10
24 children's prize card of 10
26 large recessed bin—Pacific Ocean (starting)
28 small recessed bin (intermediate)
30 large recessed bin—Hawaii (finishing)
32 colored stone for 16
34 printed message on 20
36 printed message on 22
38 printed message on 24

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A board game comprising a) a game board having thereon a sequence of playing zones, including at least a first starting playing zone and a last finishing playing zone, defining a path of travel;

b) a plurality of playing pieces, in which each said playing piece is used by each player to be positional within said playing zones on said game board;

c) a deck of standard playing cards in which two of said standard playing cards and optionally an additional third said standard playing card are dealt to each of the players, in which specific various combinations are to be made by said standard playing cards to indicate moves needed by each player, so that said playing pieces will travel along said playing zones, whereby the first player to move said respective playing piece from said first starting playing zone to said last finishing playing zone will win said same: and d) a deck of family chore cards, whereby the winning player will pick one of said family chore cards, if said game is played among family members.

2. A board to sevens game as recited in claim 1, wherein each said family chore card is yellow in color and includes a printed message thereon, so that the winning player will perform a specific task.

3. A board to sevens game as recited in claim 1, further including a deck of friends prize cards, whereby the winning player will pick one of said friends prize cards if the same game is played among friends.

4. A board to sevens game as recited in claim 3, further including a deck of children's prize cards, whereby the winning player will pick one of said children's prize cards if the game is played among children.

5. A board to sevens game as recited in claim 4, wherein said playing zones on said game board include:

a) a first starting playing zone being a large recessed bin indicating the Pacific Ocean;

b) six intermediate playing zones being small recessed bins indicating inhabited islands of Hawaii, which are Niihau, Kauai, Oahu, Molokai, Lanai and Maui; and c) said last finishing playing zone being a large recessed bin indicating the inhabited island of Hawaii.

6. A board to sevens game as recited in claim 5, wherein said playing pieces are different colored stones, which are natural to the Hawaiian islands and are each called "pohaku" in the Hawaiian language.

7. A board to sevens game as recited in claim 6, wherein said deck of standard playing cards include:

a) all of said cards numbered between two and ten representing that numerical value;

b) all of said cards being aces representing the number one; and c) all of said cards being the picture cards representing the number ten, so that when two cards are dealt to each player a combination of seven will advance said respective playing piece forward one said playing zone, when three cards are dealt to each player a combination of seven, seventeen, twenty seven, three of the same suit and a straight of three will advance said respective playing piece forward one said playing zone, while three of a kind and a straight flush of three will advance said respective playing piece forward two said playing zones and when three sevens are dealt, that player will automatically win.

8. A board to sevens game as recited in claim 7, wherein each said family chore card is yellow in color and includes a printed message thereon, so that the winning player will perform a specific task.

9. A board to sevens game as recited in claim 8, wherein each said friends prize card is green in color and includes a printed message thereon, so that the winning player being an adult will receive a specific gift.

10. An board to sevens game as recited in claim 9, wherein each said children's prize card is blue in color and includes a printed message thereon, so that the winning player being a child will receive a specific gift.

* * * * *